US010384091B1

(12) United States Patent
Baker

(10) Patent No.: US 10,384,091 B1
(45) Date of Patent: Aug. 20, 2019

(54) HAND, WRIST AND FOREARM EXERCISER

(71) Applicant: Scott Bradley Baker, Sherman Oaks, CA (US)

(72) Inventor: Scott Bradley Baker, Sherman Oaks, CA (US)

( * ) Notice: Subject to any disclaimer, the term of this patent is extended or adjusted under 35 U.S.C. 154(b) by 191 days.

(21) Appl. No.: 15/332,388

(22) Filed: Oct. 24, 2016

Related U.S. Application Data

(63) Continuation-in-part of application No. 15/235,710, filed on Aug. 12, 2016, now abandoned.

(60) Provisional application No. 62/204,651, filed on Aug. 13, 2015.

(51) Int. Cl.
*A63B 21/00* (2006.01)
*A63B 23/14* (2006.01)
*A63B 23/16* (2006.01)

(52) U.S. Cl.
CPC .... *A63B 21/00069* (2013.01); *A63B 21/4035* (2015.10); *A63B 23/14* (2013.01); *A63B 23/16* (2013.01)

(58) Field of Classification Search
CPC ..... A63B 21/00058; A63B 21/00069; A63B 21/00072; A63B 21/00076; A63B 21/00185; A63B 21/012; A63B 21/0125; A63B 21/015; A63B 21/02; A63B 21/04; A63B 21/0407; A63B 21/0414; A63B 21/0421; A63B 21/0435; A63B 21/0442; A63B 21/045; A63B 21/0455; A63B 21/15; A63B 21/159; A63B 21/22; A63B 21/4027; A63B 21/4033; A63B 21/4035; A63B 21/4039; A63B 21/4045; A63B 21/4047; A63B 21/4049; A63B 23/129; A63B 23/14; A63B 23/16; A63B 71/0054; A63B 2071/0072; A63B 2071/0081; A63B 2210/00; A63B 2210/50; A63B 2210/58; A63B 2225/09; A63B 2225/093
See application file for complete search history.

(56) References Cited

U.S. PATENT DOCUMENTS 2,126,443 A * 8/1938 Begley ..... A63B 21/015 403/114
3,248,107 A * 4/1966 Wolski ..... A63B 21/04 482/128
3,428,311 A * 2/1969 Mitchell ..... A63B 21/015 482/130
3,475,024 A * 10/1969 Lewis ..... A63B 21/0615 482/97
3,649,008 A * 3/1972 Zinken ..... A63B 23/14 482/46
4,036,490 A * 7/1977 Rice ..... A63B 21/012 482/106
4,258,913 A * 3/1981 Brentham ..... A63B 21/0083 482/112
4,344,615 A * 8/1982 Carlson ..... A63B 23/14 188/251 A (Continued)

*Primary Examiner* — Gary D Urbiel Goldner

(57) ABSTRACT

An exercise device comprises a base member and a frame member rotatably mounted on the base member. A frame movement controller is located between the base member and the frame member for selectively adjusting the degree of difficulty for rotating the frame member relative to the base member. A handle is rotatably mounted on the frame member. A handle movement controller is located between the frame member and the handle for selectively adjusting the degree of difficulty for rotating the handle relative to the frame member.

14 Claims, 9 Drawing Sheets

(56) References Cited

U.S. PATENT DOCUMENTS 4,772,015 A * 9/1988 Carlson ..... A63B 23/12 482/902
5,244,444 A * 9/1993 Wostry ..... A63B 21/0615 482/109
5,820,520 A * 10/1998 Sieber ..... A63B 23/0227 482/34
7,377,883 B1 * 5/2008 Blanton ..... A63B 21/00192 273/456
7,846,077 B2 * 12/2010 Osbak ..... A63B 21/055 482/112
8,079,941 B2 * 12/2011 Nortje ..... A63B 21/00069 482/115
9,155,932 B1 * 10/2015 Paulsen ..... B62L 3/02
9,433,815 B1 * 9/2016 Hughes ..... A63B 21/015
2005/0181914 A1 * 8/2005 Radkowski ..... A63B 69/004 482/83
2005/0187076 A1 * 8/2005 Mason ..... A63B 23/12 482/93
2006/0040799 A1 * 2/2006 Pompile ..... A63B 21/0552 482/92
2008/0076644 A1 * 3/2008 Rutherford ..... A63B 21/015 482/114
2010/0029447 A1 * 2/2010 Song ..... A63B 21/06 482/93
2010/0056348 A1 * 3/2010 James ..... A63B 21/00069 482/127
2010/0210431 A1 * 8/2010 Hinton ..... A63B 21/00047 482/141
2011/0287907 A1 * 11/2011 Morris ..... A63B 21/00069 482/117
2011/0319200 A1 * 12/2011 Ramcharan ..... A63B 69/0002 473/417
2014/0113776 A1 * 4/2014 Jaguan ..... A63B 71/023 482/57
2015/0111706 A1 * 4/2015 Broadhurst ..... A63B 22/0076 482/72
2016/0016038 A1 * 1/2016 Maholmes ..... A63B 23/0211 482/127

* cited by examiner

HAND, WRIST AND FOREARM EXERCISER

CROSS-REFERENCE TO RELATED APPLICATIONS

This application is a continuation-in-part application of U.S. patent application Ser. No. 15/235,710 filed Aug. 12, 2016, which claims the benefit of U.S. Provisional Patent Application No. 62/204,651 filed on Aug. 13, 2015, the contents of which are incorporated by reference in their entirety.

FIELD AND BACKGROUND OF THE INVENTION

This invention relates to a hand, wrist and forearm exerciser. While the exerciser in accordance with the present invention has particular applicability with respect to the hand, wrist and forearm of the user, it may also be used for exercising and development of other body parts or muscle groups, and the invention is not limited to any specific part of the body.

Many types of exercisers are known and commonly used, both in a home setting, as well as in gymnasiums or other workout centers. In some instances, exercise equipment may be somewhat general in nature, and can be used for strengthening and toning muscles of a number of different body parts. In other instances, the exercise equipment may be to some extent customized so as to be useful for specific objectives, and the strengthening and working of specific body musculature.

The durability and quality of exercise equipment may vary according to its use and location. It will be appreciated that exercise equipment which may be used in a gymnasium or commercial workout center would need to be far stronger and more durable, due to considerably more use, than that which may be used by one or two individuals in a home setting. While the present invention may be used in both home and commercial settings, it can be constructed so as to be very strong and durable in order to withstand the rigors of substantial use in a gymnasium used by many people.

SUMMARY OF THE INVENTION

According to one aspect of the invention, there is provided an exercise device comprising: a base member; a frame member rotatably mounted on the base member; a frame movement controller between the base member and the frame member for selectively adjusting the degree of difficulty for rotating the frame member relative to the base member; a handle assembly rotatably mounted on the frame member; and a handle movement controller between the frame member and the handle assembly for selectively adjusting the degree of difficulty for rotating the handle assembly relative to the frame member.

In one embodiment, the base member comprises legs and a main body frame, and the frame member comprises a substantially vertical component received within the main body frame and a substantially horizontal component mounted on the vertical component.

In a further embodiment, the frame movement controller comprises a substantially circular open ring having radially outwardly flanged ends movable between a first untightened position wherein the flanged ends are further away from each other and a second more tightened position wherein the flanged ends are nearer each other, a tightening handle for moving the flanged ends between the first position and the second position, wherein the circular ring increasingly frictionally engages with a portion of the frame member as the tightening handle is tightened. A non-flanged bushing may be located between the circular ring and the frame member. Further, the frame movement controller further comprises a lower friction bushing.

In one form, the frame member further comprises a rotational arm upper tube mounted on the horizontal component as a means for rotation of the frame member. The handle assembly may comprise a substantially cylindrical member having an axis, the cylindrical member being rotatable about the axis.

In one embodiment, the handle movement controller comprises a substantially circular open ring having radially outwardly flanged ends movable between a first untightened position wherein the flanged ends are further away from each other and a second more tightened position wherein the flanged ends are nearer each other, a tightening handle for moving the flanged ends between the first position and the second position, wherein the circular ring increasingly frictionally engages with a portion of the handle assembly as the tightening handle is tightened.

Preferably, the frame member can be selectively raised and lowered on the base member to selectively adjust the height of the frame member and a convenient location for a user. Additionally, the base member may comprise a generally vertical post and three legs extending outwardly and downwardly from the vertical post, the legs being connectable to or for positioning on a base. The vertical post may comprise a hollow tubular member, and the frame member comprises a substantially vertical component adjustably received within the hollow tubular member. Further, at least one of the legs comprises securing means for fastening the legs to a substrate.

Preferably, the handle assembly comprises a cylindrical handle which is removable and cylindrical handles of different dimensions may be substituted by selectively mounting one for another on the handle assembly.

According to a further aspect of the invention, there is provided an exercise device comprising: a base member; a frame member rotatably mounted on the base member; and a frame movement controller between the base member and the frame member for selectively adjusting the degree of difficulty for rotating the frame relative to the base member.

In yet a further aspect of the invention, there is provided an exercise device comprising: a base member; a frame member mounted on the base member; a handle assembly rotatably mounted on the frame member; and a handle movement controller between the frame member and the handle assembly for selectively adjusting the degree of difficulty for rotating the handle assembly relative to the frame member.

According to still a further aspect of the invention, there is provided a method of making an exercise device comprising: placing a base member on a surface; rotatably mounting a frame member on the base member; providing a frame member control for selectively tightening or loosening the frame member relative to the base member to adjust the degree of difficulty for rotating the frame member on the base member; rotatably mounting a handle assembly on the frame member; and providing a handle assembly control for selectively tightening or loosening the handle assembly to the frame member to adjust the degree of difficulty for rotating the frame member on the base member.

In a further aspect, there is provided a method of exercising comprising: rotating with selective degrees of difficulty a frame member which is mounted on a base member;

and rotating with selective degrees of difficulty a handle assembly which is mounted on the frame member.

The present invention therefore relates to a piece of exercise equipment preferably designed and configured to work the hand, wrist and forearm of the person using it. As mentioned above, it would certainly be within the scope of the invention that the exercise equipment of the invention be used to work out and strengthen other parts of the body as well, and the fact that it may be designed to address strengthening of the hand, wrist and forearm of the user does not exclude its application in other contexts for other muscles or muscle groups.

In one form, the invention comprises a base, and a frame or bracket mounted on the base and movable relative thereto. The frame or bracket may further include thereon a handle which can be rotated relative to the frame or bracket. The frame or bracket may be connected to the base at different or varied fastening levels so that the amount of force needed to move the frame or bracket relative to the base can be selected and adjusted by the user. Similarly, the handle mounted on the frame or bracket can be connected to the frame or bracket at different fastening levels so that the amount of force needed to rotate the handle on the frame or bracket can also be selected and adjusted by the user.

Preferably, movement of the frame or bracket relative to the base may facilitate strengthening and development of at least the wrist and forearm. Further, the movement of the handle relative to the frame or bracket may facilitate strengthening of at least the hand and wrist. There is of course an overlap, and both the frame or bracket as well as the handle can be moved at the same time so that substantially all or at least many of the muscles and muscle groups in the hand, wrist and forearm may be simultaneously exercised.

Preferably, the base comprises a generally vertical tubular member supported by a plurality of legs, preferably three in number. The legs in a preferred embodiment straddle the vertical tubular member to ensure that the exercise equipment remains stable during a user workout. The tubular member is hollow. The frame or bracket comprises a generally vertical cylindrical arm, which is received within and supported by the tubular member of the base, and a generally horizontal arm, which may also be cylindrical, mounted on the vertical cylindrical arm. The horizontal arm has the handle mounted thereon. The vertical cylindrical arm of the frame may be secured to the vertical tubular member of the base in a coaxial arrangement, and whereby the vertical tubular arm is able to rotate within the vertical tubular member and can be accommodated therein so that selected different levels of force and energy are required to rotate the vertical cylindrical arm within the tubular member. This may be achieved by providing a mechanical connector system having gripping elements between the vertical member and the vertical cylindrical arm, which may be manually adjusted so that the gripping elements engage the vertical cylindrical arm at selected levels of force. Thus, where the gripping elements engage the vertical arm with greater force, it will be more difficult and require more force and energy to rotate the vertical cylindrical arm relative to the tubular member. Conversely, lesser force engagement will have the opposite effect.

The horizontal arm of the frame may have thereon a handle which can be grasped by the user and rotated relative to the horizontal arm. The level of force by means of which the handle is selectively connected to the horizontal arm will determine the amount of force required by the user to rotate the handle. The horizontal arm of the frame may additionally have a fixed handle in the form of a tube, preferably mounted on the horizontal arm at a location near which the vertical cylindrical arm is mounted to the horizontal arm, the fixed handle functioning as a holder for the user to engage for the purposes of rotating the vertical tube.

DETAILED DESCRIPTION OF THE INVENTION

Reference is now made to the various drawings accompanying this specification which show a preferred embodiment of the invention. While the embodiment illustrated shows different views and perspectives of the exerciser of the invention, the invention is not limited to the specific details and configuration.

Figure 1:
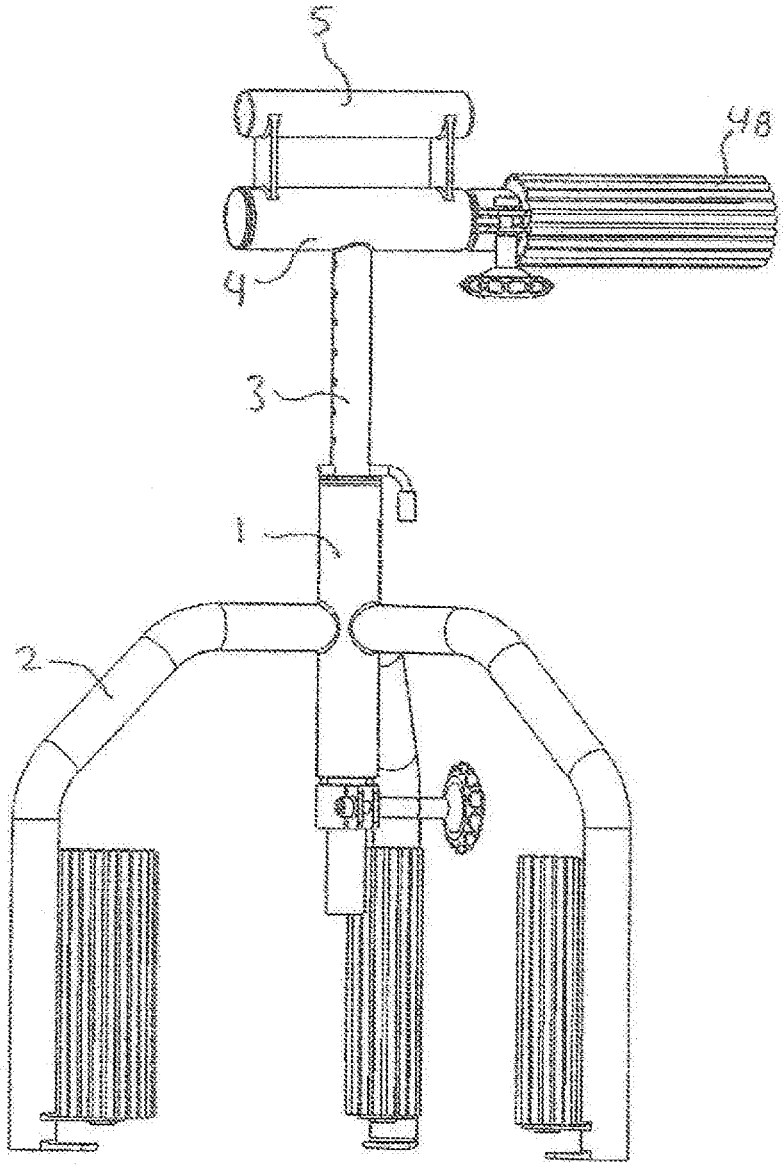
FIG. 1 is a side view of an exerciser in accordance with one aspect of the invention.

With reference to FIG. 1, there is shown a main body frame 1, and attached thereto are three main legs 2. These main legs 2 are arranged at an angularly equidistant location on the main body frame 1, and together with the main body frame 1 provide a base which is stable. The main body frame 1 is hollow and open ended, and receives a rotational arm extender 3. The rotational arm extender 3 is able to move up and down within the main body frame 1, and its height or position may be adjusted by using an adjustment pin 30 which is received within one of a plurality of holes 3A.

The rotational arm extender 3 is fixed at its top end to a rotational arm main tube 4, which has mounted thereon a rotatable handle 48. Also mounted on the main tube 4 is a rotational arm upper tube 5, which is held by the user and may be used for the purposes of rotating the rotational arm extender 3 in the main body frame 1, as will be described.

There are two systems which enable a user to selectively adjust the exercise equipment so as to customize it. A first system adjusts the grip between the rotational arm extender 3 and the main body frame 1, while a second system adjusts the grip between the rotational arm main tube 4 and the handle 48. Both of these, while similar in nature and construction, will be described further below.

Figure 2:
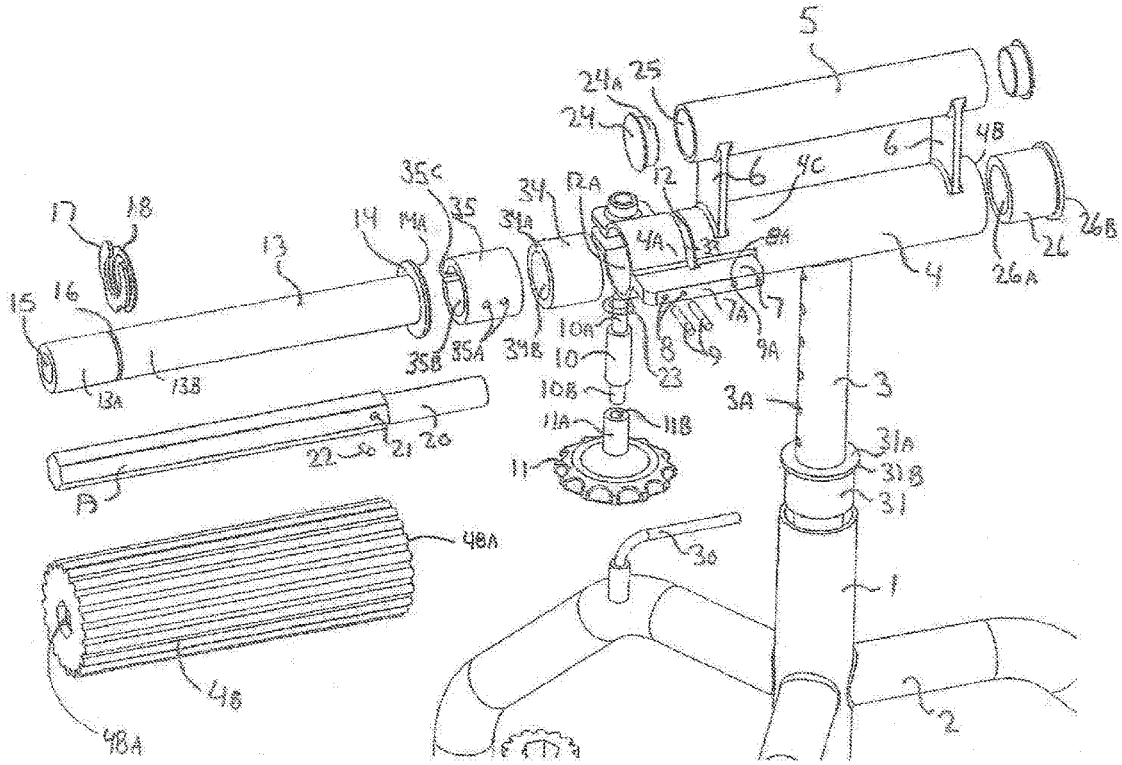
FIG. 2 is a detailed exploded view of the exerciser as shown in FIG. 1 illustrating in part the various components and their interrelationship.
Figure 3:
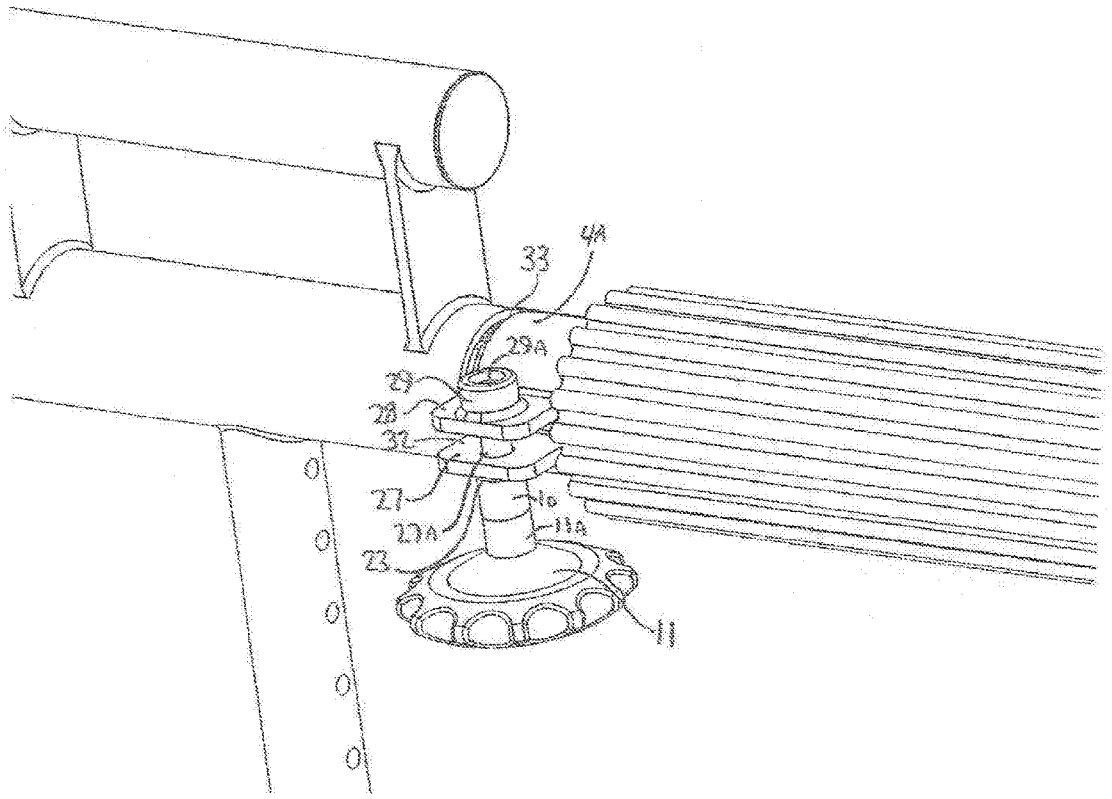
FIG. 3 is a detailed view showing a connection of the handle to the horizontal arm of the exerciser.

FIG. 2 of the drawings shows an exploded view of the rotational arm main tube 4 and its associated structure. The rotational arm main tube 4, which is hollow, receives a rotating handle main shaft 13, inserted through end 4B of the rotational arm main tube 4. The rotating handle main shaft 13 has at its one end a main shaft inner flange 14 and a main shaft outer flange 14A. At its opposite end, there is an internal retaining port 15. A clip groove 16 is provided, and borders a bushing contact area 13A on the main shaft 13, which extends over a specific length. The remainder of the handle main shaft 13 constitutes a no flange contact area 13B. The rotational arm main tube 4 has an internal opening 12 which defines a space for the bushing 34 and an internal space 12A for housing the upper friction bushing 35.

Figure 4:
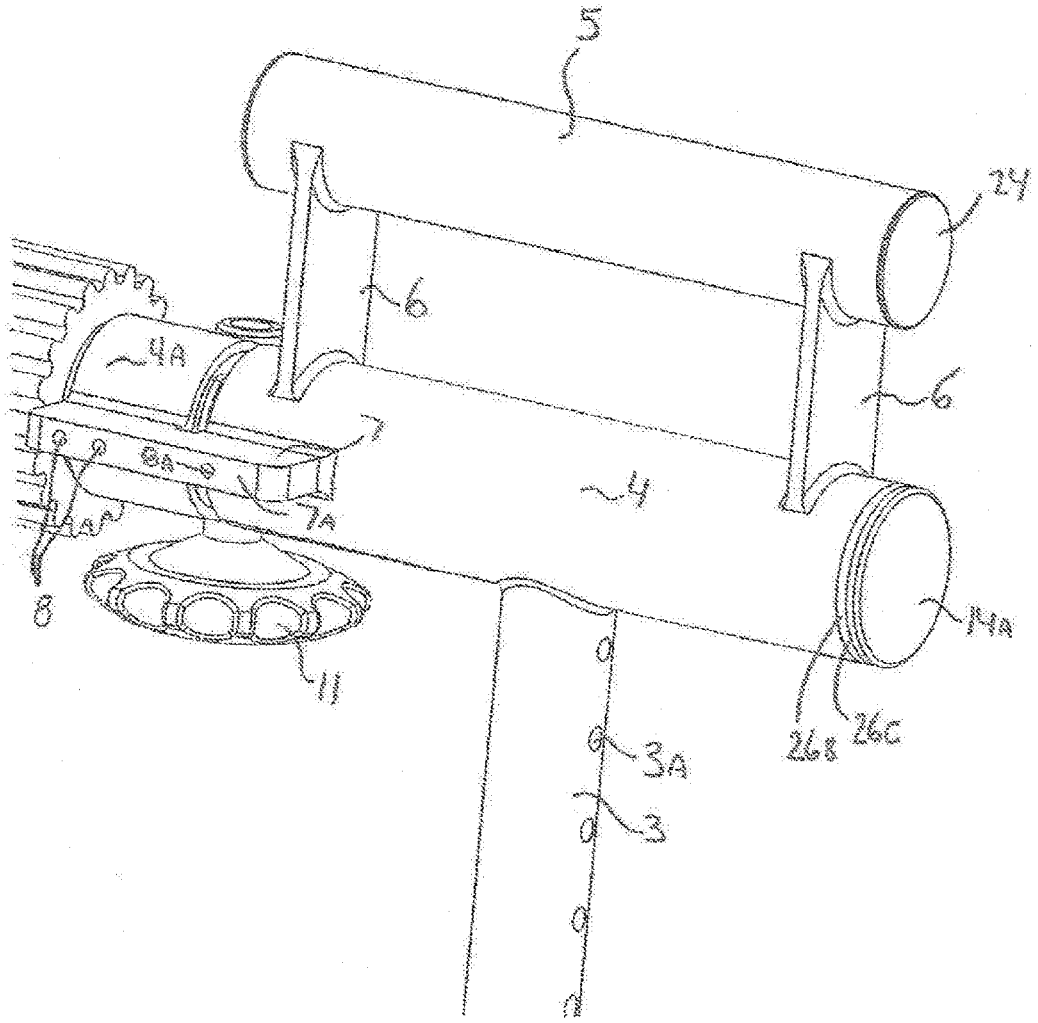
FIG. 4 is a detailed view from a different side showing a connection of the handle to the horizontal arm of the exerciser.

A flanged bushing 26 is inserted into an open end 4B of the rotational arm main tube 4. The flanged bushing 26 comprises an internal surface 26A and a flange contact surface 26B. The rotating handle main shaft 13 is inserted into the rotational arm main tube 4 through the flanged bushing 26, so that, when installed, the inner shaft flange 14 will abut against the flange contact surface 26B. The outer shaft flange 14A is outermost, as seen, for example, in FIG. 4 of the drawings.

The rotational arm main tube 4 has at its end 4C an attachment in the form of tube extension support flange 7. The support flange 7 has a drillable edge 7A and threaded lock screw holes 8 and 8A. The holes 8 receive lock screws 9, and the hole 8A receives lock screw 9A (whose functions and purpose will be described below). The extension support flange 7 connects to the rotational arm main tube 4 as well as a main tube extension 4A, which is generally coaxial with the main tube 4. There is an internal space 33 between the rotational arm main tube 4 and the main tube extension 4A. The main tube extension 4A has a lower tightening flange 27 which has a bolt clearance hole 27A, and an upper tightening flange 28. An upper threaded nub 29 is provided which has a threaded surface 29A for receiving a bolt 10. The bolt 10 is part of a tightening handle 11 including a tightening handle shaft 11A, which has internal threads 11B. The bolt 10 has a nub engagement thread 10A and a handle engagement thread 10B.

In operation, the main tube extension 4A can be adjusted so that its circumference is made slightly larger or slightly smaller by rotation of the handle 11. When the handle 11 is tightened, the lower flange 27 and the upper flange 28 are moved towards each other, since the nub engagement thread 10A engages with the threaded nub 29. By varying the circumference of the main tube extension 4A, the grip on the friction bushing contact area 13A is (indirectly) either tightened or relieved to make rotation of the main shaft 13 either more difficult or easier, as will be discussed further below.

A non-flanged bushing 34 is provided, which has an internal contact surface 34B, and a contact surface 34A for the lock screw 9A. The non-flanged bushing is accommodated within the rotational arm main tube 4 inside of the internal space 33. In other words, the non-flanged bushing 34 is located within the rotational arm main tube 4 extending from the internal space 33 towards the inside so that it is between the internal space 33 and the end 4B.

There is also provided an upper friction bushing 35, which is positioned within the rotational arm main tube 4 adjacent the internal space 33, and within the main tube extension 4A. The upper friction bushing 35 has an internal contact surface 35B, as well as screw contact insets 35A for receiving the lock screws 9. Further, the upper friction bushing 35 includes a release area 35C, which, when the upper friction bushing 35 is located within the main tube extension 4A, will preferably register with the opening between the lower tightening flange 27 and the upper tightening flange 28. However, this is not essential to the operation of the device.

When the main shaft 13 is located within the rotational arm main tube 4, the bushing contact area 13A will be substantially located within the upper friction bushing 35. A retaining clip 17 and a retaining clip washer 18 are utilized to ensure that the main shaft 13 is properly positioned within the rotational arm main tube 4 through the internal space 33 to engage with the retainer clip groove 16 formed on the main shaft 13, and defining the transition point between the friction bushing contact area 13A and the no flange contact area 13B.

The non-flanged bushing 34 is held in position by means of a lock screw 9A through lock screw holes 8A. The upper friction bushing 35 is held in position within the main tube extension 4A by means of the lock screws 9, inserted through screw holes 8, the screws engaging the screw contact insets 35A. The main shaft 13 is able to rotate within the rotational arm main tube 4, and is held in position between the flanged bushing 26, the non-flanged bushing 34, and the upper friction bushing 35. The upper friction bushing 35, due to the presence of the bushing relief area 35C, is able to have a selected and varied circumference which will change in response to the tightening and loosening of the handle 11, and the concomitant opening and closing of the lower flange 27 and the upper flange 28. Note that the presence of the tightening bolt bushing 23 ensures that the rotation of the handle 11 engages the flange 27.

A handle shaft hex insert 19 is provided having an insertable end 20, which inserts into the internal retaining port 15. The end 20 is welded or glued or otherwise fastened into the internal retaining port 15 so that it is firmly fixed therein, and will not rotate or otherwise move. The outer surface of the handle shaft hex insert 19 is, as the name indicates, hexagonal in cross-section. A threaded detent ball 22 is provided, and is accommodated within the detent ball threaded hole 21.

The handle 48 has a textured outer surface, and an internal detent ball groove 48A, generally complementary to the handle shaft hex insert 19. The handle 48 slides over the hex insert 19, and is held in position thereon by means of the detent ball 22 intersecting with the internal detent groove 48A. Note that different handles, which may have different features, dimensions and configurations, may be releasably mounted onto and easily removed from the hex insert 19.

In use, when the handle 11 is tightened, the upper and lower flanges 28 and 27 are brought towards each other, which slightly reduces the circumference of the main tube extension 4A. Simultaneously, the upper friction bushing 35 is also squeezed, made possible by the presence of the relief area 35C. The friction bushing contact area 13A is gripped more firmly, as the circumference of the upper friction bushing is reduced. This in turn makes it more difficult to rotate the main shaft 13 within the main tube 4. The user can thus select the degree of difficulty in turning or torquing the main shaft 13 (when the handle 48 is rotated), by tightening or loosening utilizing the handle 11.

Figure 5:
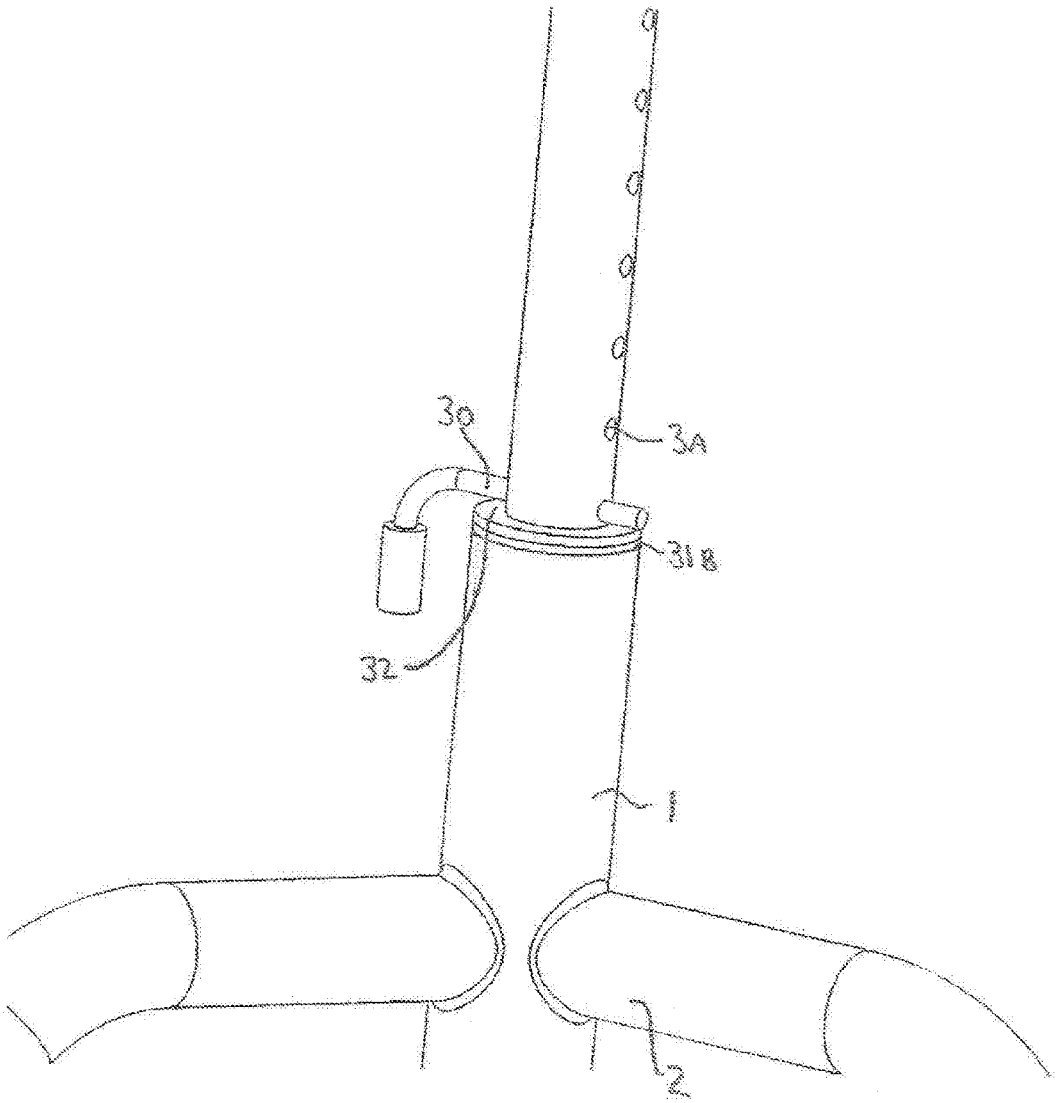
FIG. 5 is a detailed view showing the means of connection of the vertical onto the base in accordance with one aspect of the invention.

The apparatus of the invention can be utilized to strengthen musculature not only by twisting the handle 48, but also by rotating the rotational arm extender 3 within the main body frame 1, from left to right or right to left across the user's body on a horizontal plane. FIG. 5 shows the mechanism whereby the height of the rotational arm main tube 4 can be selected, with the arm extender 3 being raised or lowered to the desired position, and thereafter held in position by inserting the adjustment pin 30 through the appropriate aperture 3A in the arm extender 3. The pin 30 rests on the contact bushing 32, which is on the flange top surface 31B, thereby setting the height of the rotational arm main tube 4, but still not interfering with the rotation of the rotational arm extender 3 within the main body frame 1.

Figure 6:
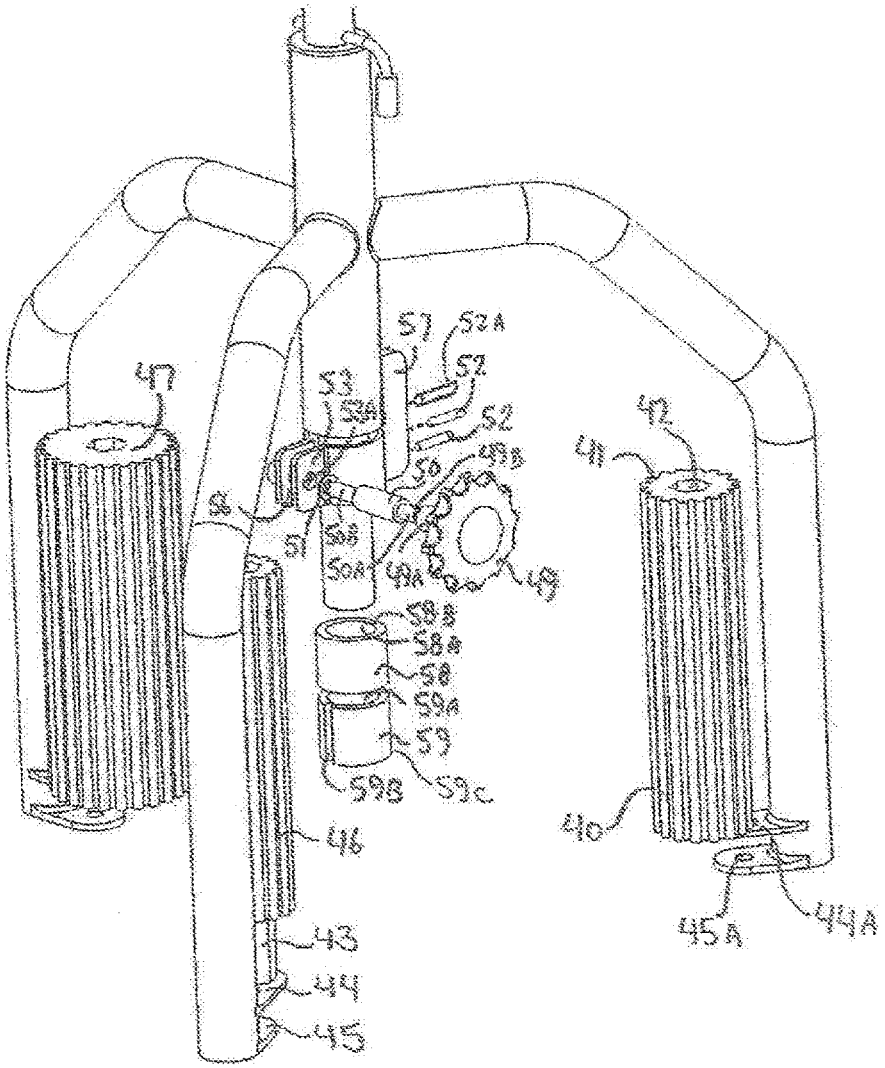
FIG. 6 is a detailed view showing components and their relationship whereby the vertical arm of the frame is connected to the base in a manner to facilitate selective forces of engagement therebetween.

Reference is now made to FIG. 6 of the drawings which shows details relating to the user's ability to select the degree of difficulty for turning the rotational arm extender 3 within the main body frame 1. It should be noted at this point that the rotational arm upper tube 5 is provided for this purpose. As seen particularly in FIG. 4 of the drawings, the rotational arm upper tube 5 is positioned on the rotational arm main tube 4 above the point where the rotational arm extender 3 is connected to the main tube 4. The rotational arm upper tube 5 is connected to the rotational arm main tube 4 by means of a pair of upper tube supports 6 therebetween. Preferably, the upper tube 5 is mounted so that the approximate center thereof more or less coincides with the axis of the rotational arm extender 3. When the user grasps the rotational arm upper tube 5, he or she may then use the hand, wrist, and forearm muscles, or at least some of them, to twist and turn the arm extender 3.

The user may select the degree of difficulty required to twist and turn the arm extender 3 within the main body frame 1. A structure for incrementally gripping and releasing the rotational arm extender 3 within the main body frame 1 is provided, and in many respects is similar to the structure already described with respect to the mechanism for turning the handle 48, illustrated in previous figures and described above.

With reference to FIG. 6 of the drawings, there is shown a handle assembly including a tightening handle 49, having internal threads 49B, a tightening bolt 50, a handle engagement thread 50A, a nub engagement thread 50B, and a tightening bolt bushing 51. A tightening flange 53 including a hole 53A receives the engagement thread 50B, the engagement thread 50B engaging a flange 54 with a threaded nub 55, having an internal threaded surface 55A. Tightening of the handle 49 causes the space 56 between the tightening flange 53 and the tightening flange 54 to be compressed or moved together. These are formed on the body tube extension 1A, which is adjacent the main body frame 1, with a free space 56C between them. An extension support flange 57 fixes the tube extension 1A to the main body frame 1. A non-flanged bushing 58, and a lower friction bushing 59, are received within the lower end of the main body frame 1 and the body tube extension 1A respectively. The non-flanged bushing 58 has an internal contact surface 58A and a contact surface 58B for a lock screw 52A, which extends through hole 60. The lower friction bushing 59 has an internal contact surface 59A, a relief area 59B, as well as an inset 59C for engagement with the lock screws 52.

In a manner generally substantially similar to that already described above, tightening of the handle 49 causes the flanges 53 and 54 to move together, at the same time squeezing the lower friction bushing 59. As the lower friction bushing 59 is squeezed, its circumference will diminish slightly due to the presence of the relief area 59B. By incrementally tightening or loosening the handle 49, the grip on the arm extender 3 will increase or decrease, so that the user may adjust to a fairly significant degree the level of difficulty which will be required in order to rotate the arm extender 3 within the main body frame 1.

Figure 7:
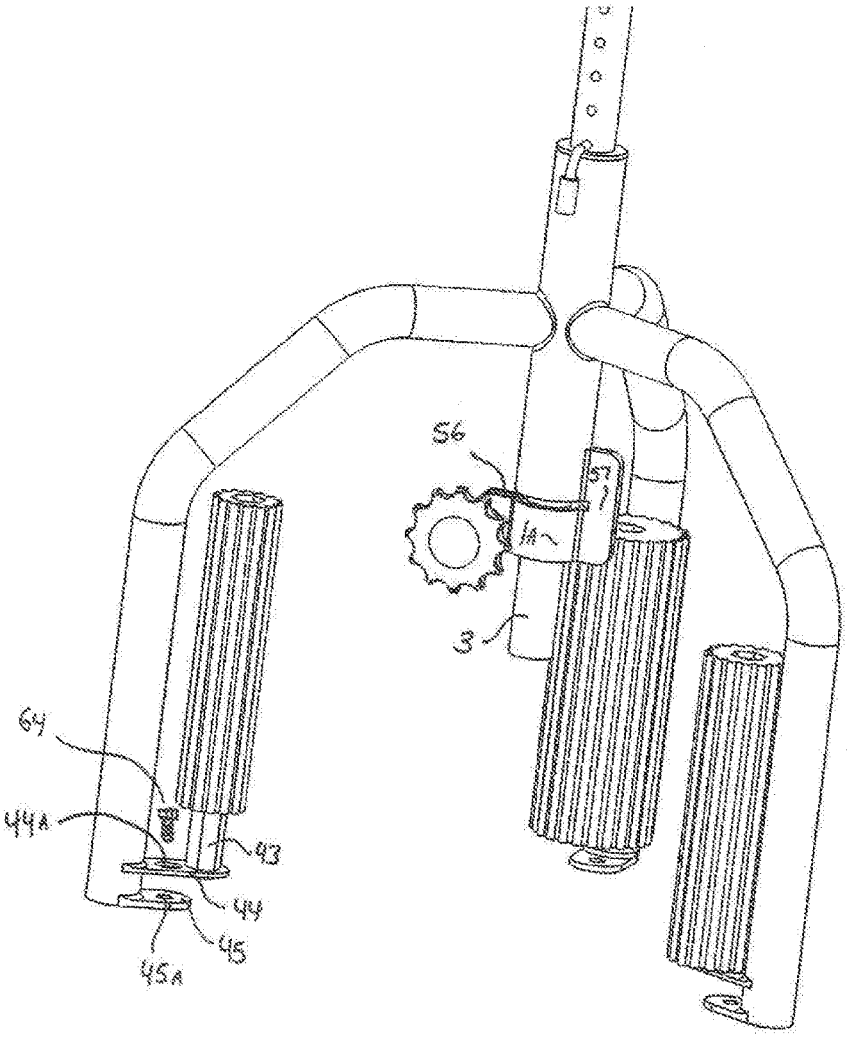
FIG. 7 is a further view of the base and part of the frame in accordance with an aspect of the invention.
Figure 8:
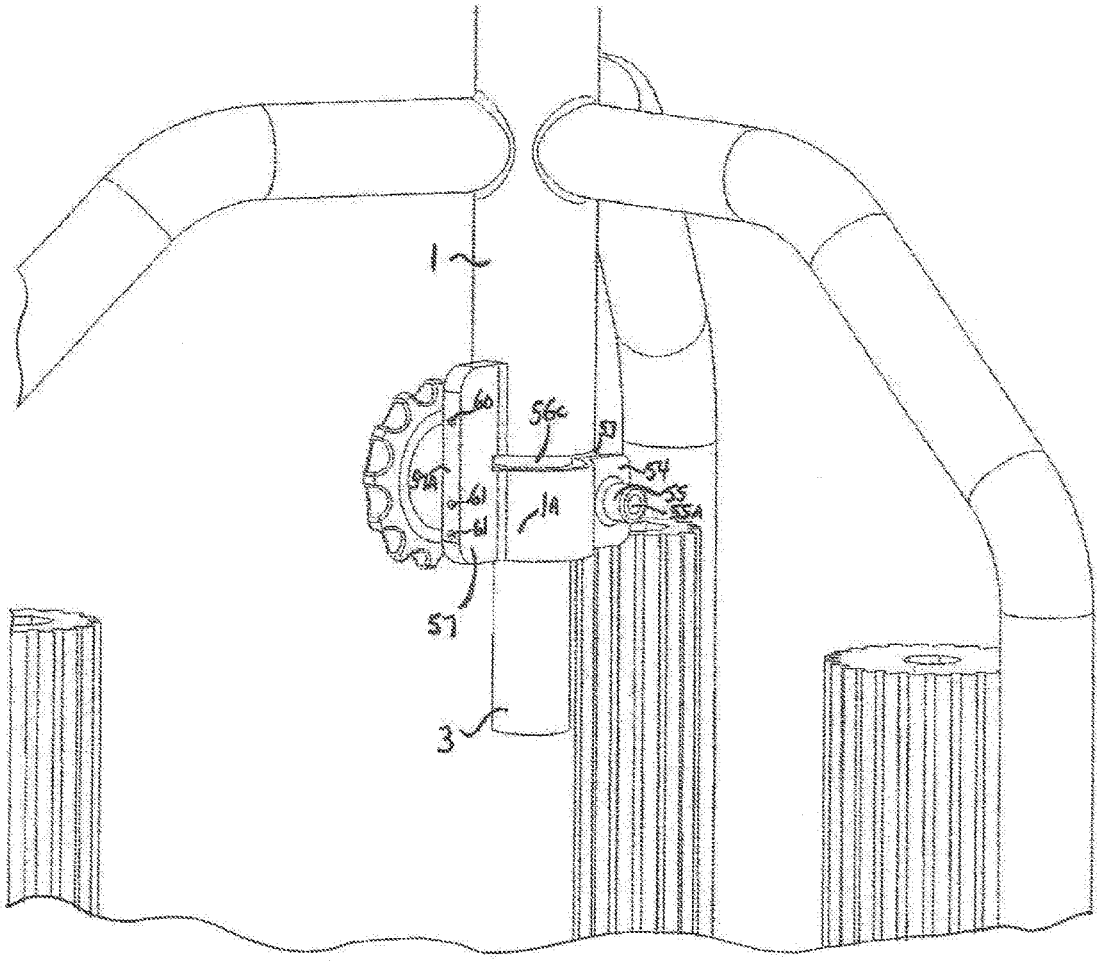
FIG. 8 shows a detailed view of the connection between the base and the frame from a different angle.

FIG. 7 of the drawings shows a detail of the main legs 2. Each leg 2 has a mounting foot flange 45 with a bolt hole 45A by means of which all or some of the legs 2 may be affixed to a surface or platform. Further, each leg 2 may include storage post flanges 44 so that differently configured and dimensioned handles may be stored upon the post 43 for use until desired by the user. The flange 44 has a hole 44A which allows a mounting bolts access to bolt hole 45A. Mounting bolts 64 facilitate connection to the ground or a platform 62.

Figure 9:
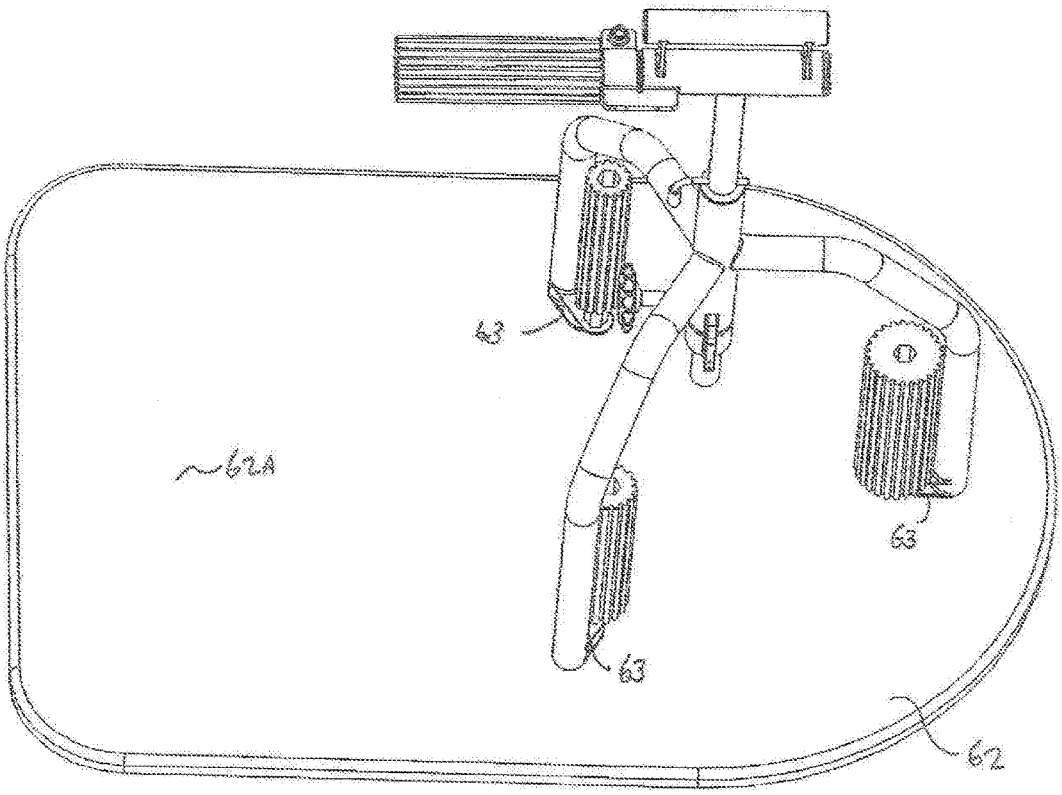
FIG. 9 shows a top perspective view of an exerciser in accordance with the invention mounted on a foundational platform.

FIG. 9 of the drawings shows the apparatus mounted on a foundational platform 62, which may have a skid resistant surface 62A. Mounting points 63 are provided by means of which the apparatus may be secured to the platform 62 in order to facilitate and enhance the stability of the device in use.

An exercise device constructed and operating in the manner set forth above therefore gives a user the ability to exercise through two distinct movement processes. The first, when the user holds the rotational upper tube 5, allows the user to rotate the rotational arm extender 3 relative to the main body frame 1. The amount of force required to effect such rotation can be adjusted and selected from easy to extremely difficult, according to the desired levels required by the user. The second, when the user holds the handle 48, allows the user to rotate the handle 48 relative to the rotational arm main tube 4. The amount of force required to effect such rotation can, once more, be adjusted and selected from easy to extremely difficult, according to the desired levels required by the user.

The user may use either one of these processes individually, or both together, with each one independently set by degree of difficulty according to the type of workout desired.

The invention may further include other features, including meters or systems for setting the degree of difficulty so that these can be effected more precisely. Further, while the various embodiments described herein show certain specific mechanisms for adjusting the degree of difficulty as referenced above, other types of structures and configurations may be used to effect the same purpose. In essence, therefore, the invention relates to a piece of exercise equipment which have components able to be rotated in different dimensions and to work different musculature and body parts. While the invention is directed at the strengthening of the hand, wrist and forearm muscles, or at least some of these, it is within the scope of the invention that the exercise equipment be used in other contexts as well so that other parts of the body may separately or additionally be exercised by utilizing the present invention.

Generally, having stronger grip strength is of great benefit. Whether a professional athlete or a grandmother opening a jar of peanut butter, grip strength is important. The present invention is able to benefit users by building functional grip strength and functional wrist and forearm strength. Grip strength is involved in every exercise movement performed on the hand, wrist and forearm exercising device.

The higher the resistance is set for any given movement, the tighter the user must squeeze the handle in order to turn or rotate that handle. Muscles that are engaged to grip are at the top of the list of those worked by the device of the present invention. Most of the muscles that grip are also involved in wrist flexion and vice versa. Muscles that oppose grip and wrist flexion are the extensors. And finally, there are the wrist/forearm pronators and supinators that basically rotate the wrist and/or forearm clockwise or counter-clockwise.

The following list identifies at least some of the gripping muscles utilized in every exercise the HWF offers: Flexor Carpi Radialis, Palmaris Longus, Flexor Carpi Ulnaris, Flexor Digitorum Superficialis, Flexor Digitorum Profundus, Flexor Pollicis Longus, Flexor Pollicis Brevis, Adductor Pollicis, Opponens Pollicis, Flexor Digiti Minimi Brevis, Opponens Digiti Minimi, Interossei and Lumbricals, Palmar Interossei.

The following list identifies at least some of the Wrist Flexion Muscles engaged in an exercise where the user faces the device, grasps the lower handle with the left hand and rotates the handle counter-clockwise: Flexor Carpi Radialis, Palmaris Longus, Flexor Carpi Ulnaris, Flexor Digitorum Superficialis, and Flexor Digitorum Profundus.

This following list identifies at least some of the Wrist Extensor Muscles engaged in and exercise where the user faces device, grasps the lower handle with the left hand and rotates the handle clockwise: Extensor Carpi Radialis Longus, Extensor Carpi Radialis Brevis, Extensor Digitorum, Extensor Indicis, and Extensor Carpi Ulnaris.

The following list identifies Wrist/Forearm Pronator Muscles engaged in the exercise where the user grasps the top handle with left hand and rotates the handle clockwise: Anconeus, Pronator Teres, and Pronator Quadratus.

The following list identifies Wrist/Forearm Supinator Muscles engaged in the exercise where the user grasps the top handle with left hand and rotates the handle counter-clockwise: Biceps Brachii; Supinator; Extensor Pollicis Brevis; and Opponens Pollicis.

In one embodiment, the device of the invention can be engineered in a very minimalistic way, no or few extras for flash and wow, just what is needed. The moving components may operate through a series of bronze bushings for smooth fluid movement and stability. The friction bushings and "handles" may be produced from a hard yet smooth plastic with exceptional wear qualities.

One of the end goals in engineering the device in accordance with one aspect of the present invention was for a 20+ year lifespan with no replacement parts needed due to product wear or failure, while occupying minimal floor space and delivering maximum benefits. Whether in a home or commercial facility the device may be a "staple" addition to the routine of exerciser's where many may benefit from improved hand strength, especially hand strength that is improved in a natural movement exercise.

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

The invention claimed is:

1. An exercise device comprising:

a base member including a main center vertical tube with a vertical axis and a vertical rotation controller;

a frame member including: a frame member vertical tube insertably coupled to the main center vertical tube along the vertical axis such that the frame member is rotatably mounted on the base member; a lower horizontal tube mounted atop the frame member vertical tube and comprising a horizontal axis and a horizontal rotation controller; a handle assembly insertably coupled to the lower horizontal tube along the horizontal axis such that the handle assembly is rotatably mounted on the lower horizontal tube; and an upper horizontal tube transfixed directly above and spaced apart from the lower horizontal tube;

wherein the upper horizontal tube is utilized to rotate the frame member about the vertical axis;

wherein the vertical rotation controller is configured for increasing and decreasing a resistance to rotation of the frame member vertical tube about the vertical axis; and wherein the horizontal rotation controller is configured for increasing and decreasing a resistance to rotation of the handle assembly about the horizontal axis.

2. The exercise device as claimed in claim 1 wherein the base member further comprises three legs.

3. The exercise device as claimed in claim 1 wherein the vertical rotation controller is connected to a lower part of the main center vertical tube and comprises a tightening handle, a collapsible friction bushing, and a substantially circular open ring concentrically disposed about the collapsible friction bushing and the frame member vertical tube, the substantially circular open ring having radially outwardly flanged ends movable between a first untightened position, wherein the radially outwardly flanged ends are spaced apart from each other such that the collapsible friction bushing is in an unsqueezed position about the frame member vertical tube, and a plurality of tightened positions, wherein turning the tightening handle moves the radially outwardly flanged ends from the first untightened position to the plurality of tightened positions by respectively drawing the radially outwardly flanged ends nearer to each other and correspondingly squeezing the collapsible friction bushing about the frame member vertical tube, the turning of the tightening handle thereby allowing for the increasing and decreasing of the resistance to rotation of the frame member vertical tube about the vertical axis.

4. The exercise device as claimed in claim 3 wherein the vertical rotation controller further comprises a non-collapsible non-flanged bushing.

5. The exercise device as claimed in claim 1 wherein the handle assembly comprises a substantially cylindrical member having an axis collinear with the horizontal axis of the lower horizontal tube, the cylindrical member being rotatable about the axis.

6. The exercise device as claimed in claim 1 wherein the horizontal rotation controller is connected to an end of the lower horizontal tube and comprises a tightening handle, a collapsible friction bushing, and a substantially circular open ring concentrically disposed about the collapsible friction bushing and a portion of the handle assembly, the substantially circular open ring having radially outwardly flanged ends movable between a first untightened position, wherein the radially outwardly flanged ends are spaced apart from each other such that the collapsible friction bushing is in an unsqueezed position about the portion of the handle assembly, and a plurality of tightened positions, wherein turning the tightening handle moves the radially outwardly flanged ends from the first untightened position to the plurality of tightened positions by respectively drawing the radially outwardly flanged ends nearer to each other and correspondingly squeezing the collapsible friction bushing about the portion of the handle assembly, the turning of the tightening handle thereby allowing for the increasing and decreasing of the resistance to rotation of the handle assembly about the horizontal axis.

7. The exercise device as claimed in claim 6 wherein the lower horizontal tube of the frame member further comprises a non-collapsible non-flanged bushing, and a non-collapsible flanged bushing.

8. The exercise device as claimed in claim 7 wherein the collapsible friction bushing of the horizontal rotation controller is located between the end of the lower horizontal tube and the portion of the handle assembly.

9. The exercise device as claimed in claim 1 wherein the frame member can be selectively raised and lowered on the base member to selectively adjust a height of the frame member such that the frame member is configured to selectively adjust a convenient location for a user.

10. The exercise device as claimed in claim 1 wherein the base member further comprises three legs extending outwardly and downwardly from the main center vertical tube, the three legs being connectable to or for positioning on a base or a substrate.

11. The exercise device as claimed in claim 10 wherein the main center vertical tube of the base member is a hollow tubular member within which the frame member vertical tube is adjustably received.

12. The exercise device as claimed in claim 10 wherein at least one of the three legs comprises securing means for fastening the at least one of the three legs to the base or substrate.

13. The exercise device as claimed in claim 1 wherein the handle assembly comprises a single cylindrical handle which is removable and selectively replaceable with one of a plurality of cylindrical handles respectively having different dimensions.

14. The exercise device as claimed in claim 1 wherein a height of the frame member relative to the base member can be adjusted by placing a selector pin through one of a plurality of holes in the frame member vertical tube, the selector pin engaging only through the frame member vertical tube and sitting atop a non-collapsible flanged bushing at an upper end of the main center vertical tube of the base member.

* * * * *